US005316302A

United States Patent [19]

Sedberry

[11] Patent Number: 5,316,302

[45] Date of Patent: May 31, 1994

[54] GOLF GAME OF SKILL AND CHANCE

[76] Inventor: William C. Sedberry, 632-31st Ave. N., Apt. 35-A, Columbus, Miss. 39701

[21] Appl. No.: 930,264

[22] Filed: Aug. 14, 1992

[51] Int. Cl.[5] ..... A63F 7/06; A63B 69/36

[52] U.S. Cl. ..... 273/87 C; 273/176 F; 273/87 F

[58] Field of Search ..... 273/87 C, 87 F, 176 R, 273/32 R, 176 E, 176 L, 176 F, 87 R

[56] References Cited

U.S. PATENT DOCUMENTS

| | | | |
|---|---|---|---|
| 1,338,963 | 5/1920 | Rolfe | 273/176 F |
| 3,038,726 | 6/1962 | Hesidence | 273/176 F |
| 3,342,494 | 9/1967 | Talley | 273/176 F |
| 3,464,704 | 9/1969 | Nelson | 273/176 F |
| 3,843,136 | 10/1974 | Buenzle | 273/176 F |
| 4,053,155 | 10/1977 | Williams | 273/87 C |
| 4,743,026 | 5/1988 | Eady | 273/87 F |
| 4,934,704 | 6/1990 | Mazer | 273/176 L |
| 5,039,103 | 8/1991 | Sammons | 273/176 F |

FOREIGN PATENT DOCUMENTS

| | | | |
|---|---|---|---|
| 12045 | 1/1977 | Japan | 273/176 F |
| 2198960 | 6/1988 | United Kingdom | 273/87 G |

*Primary Examiner*—Mark S. Graham
*Attorney, Agent, or Firm*—Richard L. Miller

[57] ABSTRACT

A golf game of skill and chance intended for two to four players is provided and consists of a playing board with a course end having a plurality of cups and an opposite end having a single cup. A plurality of lines are transversely positioned at the course end and the opposite end of the playing board. A plurality of game cards have indicia thereon to match up with some of the cups on the playing board to indicate to each player how to play the game. A score pad for each player is to keep a written record of the score during the play of the game. A golf ball and a putter club is provided for each player. Each player can stand on the playing board and hit their respective golf ball into one of the cups, as indicated by one game card picked.

5 Claims, 1 Drawing Sheet

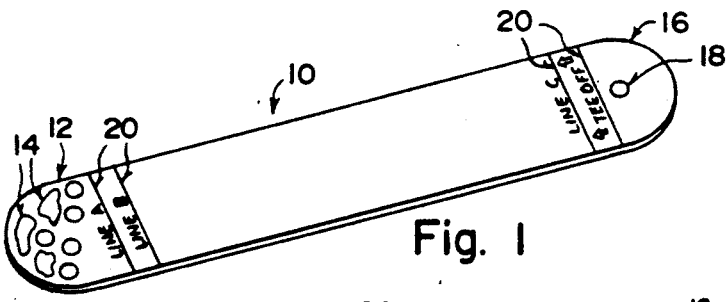
Fig. 1
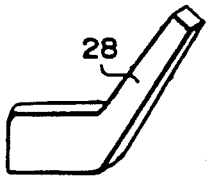
Fig. 8
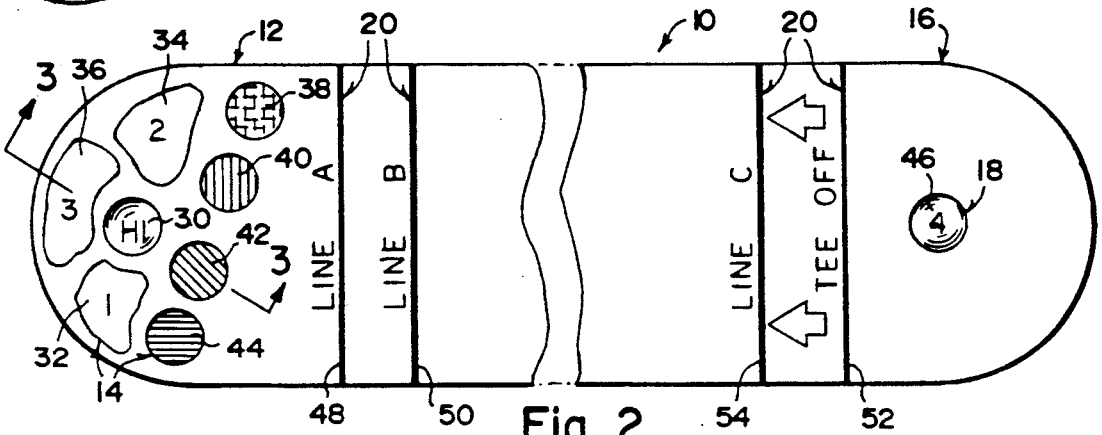
Fig. 2
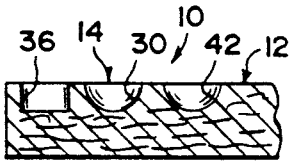
Fig. 3
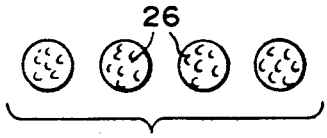
Fig. 4
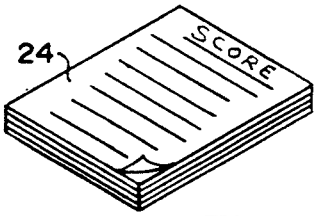
Fig. 7
Fig. 5
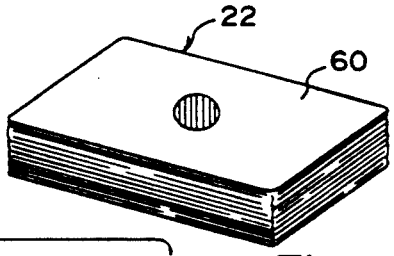
Fig. 6
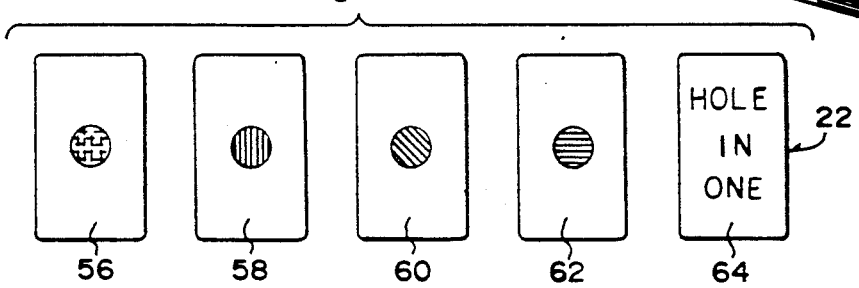

GOLF GAME OF SKILL AND CHANCE

BACKGROUND OF THE INVENTION

The instant invention relates generally to simulated golf games and more specifically it relates to a golf game of skill and chance.

Numerous simulated golf games have been provided in the prior art that are adapted to be played on a game board. For example, U.S. Pat. Nos. 3,771,792 to Crumlish; 3,910,581 to Nicholson and 4,380,338 to Lacy all are illustrative of such prior art. While these units may be suitable for the particular purpose to which they address, they would not be as suitable for the purpose of the present invention as hereafter described.

SUMMARY OF THE INVENTION

A primary object of the present invention is to provide a golf game of skill and chance that will overcome the shortcomings of the prior art devices.

Another object is to provide a golf game of skill and chance which enables each player of the game to actually stand on an elongated playing board and hit a golf ball as determined by a pick of a game card.

An additional object is to provide a golf game of skill and chance that will allow each player to combine their skill in playing the game with chance when picking a game card, so as to entertain all the players.

A further object is to provide a golf game of skill and chance that is simple and easy to use.

A still further object is to provide a golf game of skill and chance that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic perspective view of the playing board of the instant invention;

FIG. 2 is an enlarged elevational view with parts broken away showing the playing board in greater detail;

FIG. 3 is a diagrammatic cross sectional view taken on line 3—3 of FIG. 2;

FIG. 4 is a perspective view of just the golf balls per se;

FIG. 5 is a diagrammatic view of one of each of the games cards required to play the game;

FIG. 6 is a diagrammatic perspective view of a typical set of the game cards of the instant invention;

FIG. 7 is a diagrammatic perspective view of one of the score pads for recording strokes made in the play of the game; and FIG. 8 is a diagrammatic perspective view of one of the putters used to play the game.

DETAILED DESCRIPTION OF THE PREFERRED EMBODIMENTS

Turning now descriptively to the drawings, in which similar reference characters denote similar elements throughout the several views, the Figures illustrate a golf game of skill and chance which consists of a playing board 10 typically about eight feet long and approximately eighteen inches wide with a course end 12 having a plurality of cups 14 and an opposite end 16 having a single cup 18. A plurality of lines 20 are transversely positioned at the course end 12 and the opposite end 16 of the playing board 10. A plurality of game cards 22 have indicia thereon to match up with some of the cups 14 on the playing board 10 to indicate to each player how to play the game. A score pad 24 is for each player to keep a written record of the score during the play of the game. A golf ball 26 and a putter club 28 is provided for each player. Each player can stand on the playing board 10 and hit their respective golf ball 26 into one of the cups 14, as indicated by one game card 22 picked.

The cups 14 located in the course end 12 of the playing board 10 are eight in number and are identified as a hole in one cup 30 having indicia H1, a water hazard cup 32 having indicia 1-lose one stroke, a sand trap cup 34 having indicia 2,-lose one stroke, an out of bounds cup 36 having indicia 3,-lose two strokes, a yellow cup 38, a red cup 40, a green cup 42 and a blue cup 44. The cup 18 located in the opposite end 16 of the playing board 10 is identified as hole out cup 46 and has indicia 4 thereon.

The lines 20 include a first line 48 identified as line "A" located adjacent the cups 14 at the course end 12 of the playing board 10. A second line 50 identified as line "B" is located spaced behind the line "A" 48. A third line 52 identified as tee off line is located adjacent the hole out cup 46 at the opposite end 16 of the playing board 10. A fourth line 54 identified as line "C" is located spaced behind the tee off line 52. The game cards 22 are a deck of thirty-six cards which contains eight cards identified as the yellow cup 56, eight cards identified as the red cup 58, eight cards identified as the green cup 60, eight cards identified as the blue cup 62 and four cards identified as hole in one cup 64.

RULES FOR PLAYING THE GOLF GAME

1. The deck of cards 22 is shuffled and placed face down.

2. Each player draws one card 22 per turn and must shoot from the tee off line 52 for the same color cup or the hole in one cup as picked from the deck.

3. If four players play, the game is nine holes, thus using all thirty-six cards, but this is flexible.

4. If a player makes the same color cup 14 as a card 22 drawn, the player is allowed to place the golf ball 26 on line "A" 48 and shoot back to the hole out cup 46.

5. If successful, the player records a "Par 2" on the score sheet pad 24.

6. If not successful, the player shoots again from line "C" 54 and records the total strokes.

7. If the player makes any other color cup or lands in the sand trap cup 34 or the water hazard cup 32, one stroke is lost and the player must putt back to the hole out cup 46 from line "B" 50 and record the total strokes.

8. If the player lands in the out of bounds cup 36, two strokes are lost and the player must putt from line "B" 50 and record the total strokes on the score card pad 24.

9. A player cannot declare a hole in one unless the card 64 was drawn initially.

10. The player simply looses one stroke and putts back to the hole out cup 46 from line "B" 50.

11. A player shooting a golf ball 26 not going in a cup 14 on a first shot after a card 22 is drawn must shoot again from line "C" 54 and loose one stroke.

12. The player with the best score after nine holes wins.

13. In case of a tie, the games goes into sudden death.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A golf game of skill and chance which comprises:

a) a playing board having a playing surface with a course end having a plurality of golf ball receiving cups under the playing surface and an opposite end having a single golf ball receiving cup under the playing surface;

b) a plurality of putting start lines transversely positioned at the course end and the opposite end of said playing board respectively, between said plurality of golf ball receiving cups and said single golf ball receiving cup;

c) a plurality of game cards having indicia thereon to match up with some of the cups on said playing board to indicate to each player how to play the game;

d) a score pad for each player to keep a written record of the score during the play of the game;

e) a golf ball for each player; and f) a putter club, so that each player can in turn stand on said playing board and initially hit a respective golf ball from a start line at the opposite ends towards one of the golf ball receiving cups at the course end for receipt therein, as indicated by one of said game cards picked and, subsequently hit the respective golf ball towards either end of the playing board without modification of the playing surface thereof from a putting start line selected from one at the course end and the opposite end towards a selected one of the plurality of cups and the single cup respectively, according to whether the respective golf ball was successfully received in the indicated golf ball receiving cup as a result of the initial hit.

2. A golf game of skill and chance as recited in claim 1, further including;

a) the golf ball receiving cups located in the course end of said playing board being eight in number and identified as a hole in one cup, a water hazard cup-lose one stroke, a sand trap cup-lose one stroke, an out of bounds cup-lose two strokes, a yellow cup, a red cup, a green cup and a blue cup; and b) the golf ball receiving cup located in the opposite end of said playing board identified a hole out cup, the water hazard cup, said trap cup and the out of bounds cup each having non-circular mouth greater in size than mouthes of other cups and at least one of the water hazard cup said trap cup and out of bounds cup being located between an endmost tip of the course end and at least some of the golf ball receiving cups.

3. A golf game of skill and chance as recited in claim 2, wherein said putting start lines include:

a) a first putting start line identified as line "A" located adjacent the golf ball receiving cups at the course end of said playing board;

b) a second putting start line identified as line "B" located spaced behind said line "A";

c) a third putting start line identified as a tee off line located adjacent the hole out cup at the opposite end of said playing board; and d) a fourth putting start line identified as line "C" located spaced behind said tee off line.

4. A golf game of skill and chance as recited in claim 3, wherein said game cards are a deck of thirty-six cards which include:

a) eight said cards identified as the yellow cup;

b) eight said cards identified as the red cup;

c) eight said cards identified as the green cup;

d) eight said cards identified as the blue cup; and e) four said cards identified as the hole in one cup.

5. A golf game of skill and chance as recited in claim 1, wherein the playing board is generally eight feet long and eighteen inches wide.

* * * * *